US011231666B1

(12) United States Patent
Takai

(10) Patent No.: US 11,231,666 B1
(45) Date of Patent: Jan. 25, 2022

(54) DEVELOPING DEVICE AND IMAGE FORMING APPARATUS INCLUDING SAME

(71) Applicant: KYOCERA Document Solutions Inc., Osaka (JP)

(72) Inventor: Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/377,252

(22) Filed: Jul. 15, 2021

(30) Foreign Application Priority Data

Jul. 21, 2020 (JP) ..... JP2020-124253

(51) Int. Cl.
*G03G 15/08* (2006.01)

(52) U.S. Cl.
CPC ..... *G03G 15/0889* (2013.01)

(58) Field of Classification Search
CPC ..... G03G 15/0889; G03G 15/0891; G03G 15/0893; G03G 15/0898; G03G 15/757
See application file for complete search history.

(56) References Cited

U.S. PATENT DOCUMENTS 6,980,753 B2 * 12/2005 Yoshiki ..... G03G 15/0817 399/103
2009/0080943 A1 * 3/2009 Kato ..... G03G 9/08755 399/256

FOREIGN PATENT DOCUMENTS

JP 2000-250309 A 9/2000

* cited by examiner

*Primary Examiner* — Hoang X Ngo
(74) *Attorney, Agent, or Firm* — Stein IP, LLC

(57) ABSTRACT

A developing device includes a developing container, a bearing, a stirring transport member, and a seal member. The bearing is inserted and fixed to a through hole provided to the developing container. The bearing includes a bearing side engaging part formed on outer periphery surface of the bearing to have outer diameter different from that of other part in the axial direction of the bearing, a first outer periphery part positioned inside the bearing side engaging part in the axial direction, and a second outer periphery part positioned outside the same in the axial direction. A container side engaging part engaging with the bearing side engaging part is formed on inner periphery surface of the through hole at the same position in the axial direction as the bearing side engaging part, to have inner diameter different from that of other part in the axial direction of the through hole.

7 Claims, 6 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2020-124253 filed on Jul. 21, 2020, the entire contents of which are hereby incorporated by reference.

BACKGROUND

The present disclosure relates to a developing device mounted in an image forming apparatus using an electrophotographic method, such as a copier, a printer, a facsimile machine, or a multifunction peripheral thereof, the developing device including a stirring transport member that stirs and transports developer, and to an image forming apparatus including the developing device.

In an image forming apparatus, a latent image formed on an image carrier constituted of a photosensitive body and the like is developed by a developing device so that the image is visualized as a toner image. The developing device stores developer containing toner in a developing container, and includes a developing roller for supplying the developer to the image carrier and a stirring transport member for supplying the developer in the developing container to the developing roller while stirring and transporting the same.

As such a developing device, Patent Document 1 discloses one that includes a developing container that stores developer, a developer stirring transport member disposed in the developing container, a bearing that supports the developer stirring transport member in a rotatable manner. The developer stirring transport member includes a rotation shaft supported by the bearing in a rotatable manner, and a stirring blade formed on an outer periphery surface of the rotation shaft. When the stirring blade rotates about the rotation shaft, the developer in the developer storing part circulates in the developing container and is supplied to the developing roller.

SUMMARY

A developing device according to an aspect of the present disclosure is a developing device including a developing container, a developer carrier, a bearing, a stirring transport member, and a seal member. The developing container contains developer containing toner. The developer carrier carries on its surface the toner in the developing container. The bearing is fixed by being inserted in a through hole formed on the developing container. The stirring transport member includes a rotation shaft supported by the bearing in a rotatable manner, and a stirring blade formed on an outer periphery surface of the rotation shaft, so as to stir and transport the developer in the developing container. The seal member is disposed between the bearing and the rotation shaft. The developing container has an upper housing and a lower housing connected to the upper housing, and the through hole is divided into an upper housing side and a lower housing side. The bearing includes a bearing side engaging part formed on an outer periphery surface of the bearing to have an outer diameter different from that of other part in an axial direction of the bearing, a first outer periphery part positioned inside the bearing side engaging part in the axial direction, and a second outer periphery part positioned outside the same in the axial direction. On an inner periphery surface of the through hole, at the same position in the axial direction as the bearing side engaging part, a container side engaging part, which engages with the bearing side engaging part, is formed to have an inner diameter different from that of other part in an axial direction of the through hole.

DETAILED DESCRIPTION

Hereinafter, with reference to the drawings, a first embodiment of the present disclosure is described. Note that a direction along a rotation shaft 25*b*, 26*b* of a developing device 3*a* to 3*d* of the present disclosure is referred to as an "axial direction". In addition, a direction along a radial direction of the rotation shaft 25*b*, 26*b* is referred to as a "radial direction". Further, a rotation direction about the rotation shaft 25*b*, 26*b* is referred to as a "circumferential direction".

Figure 1:
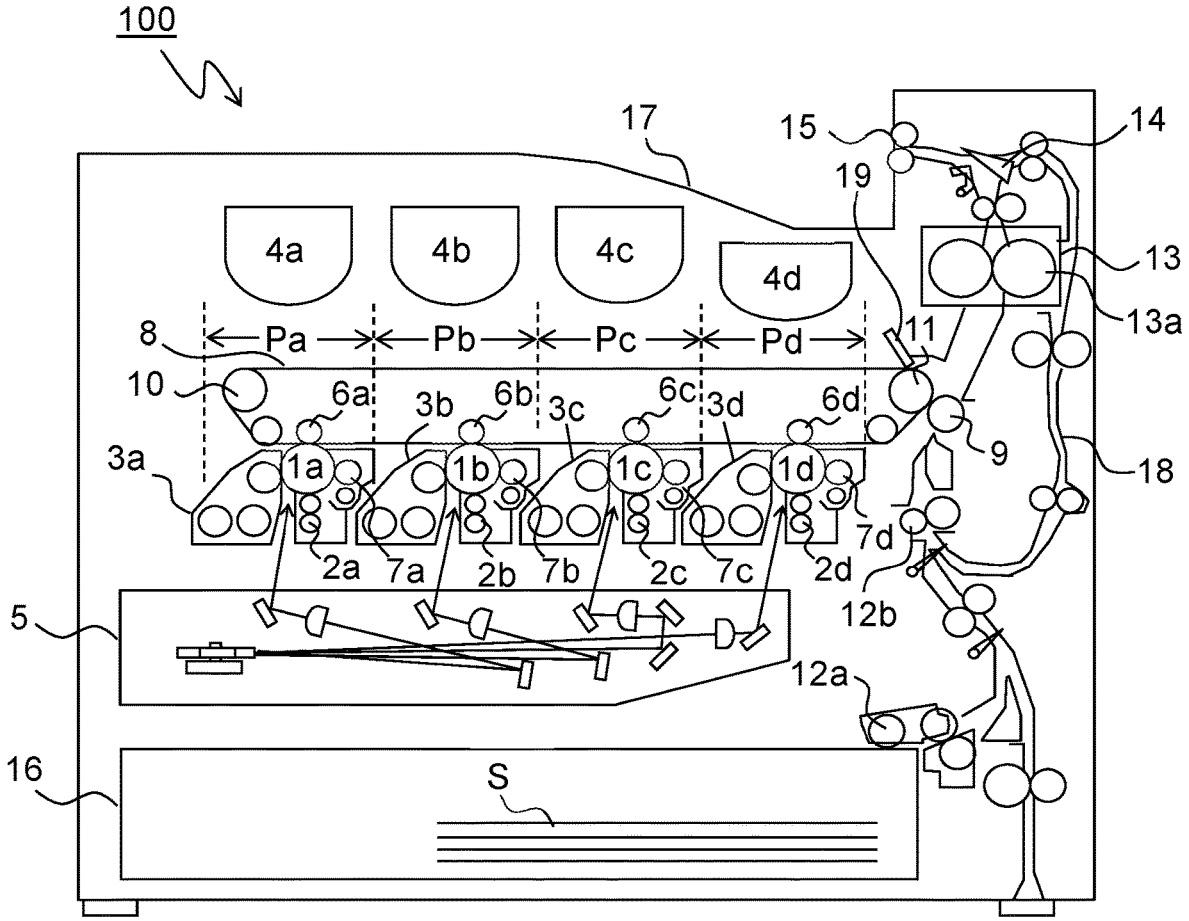
FIG. 1 is a cross-sectional view illustrating an internal structure of an image forming apparatus including a developing device according to a first embodiment of the present disclosure.

FIG. 1 is a cross-sectional view illustrating an internal structure of an image forming apparatus 100 including the developing devices 3*a* to 3*d* according to the first embodiment of the present disclosure. Four image forming units Pa, Pb, Pc and Pd are disposed in a main body of the image forming apparatus 100 (e.g. a color printer) in order from an upstream side (left side in FIG. 1) in the conveying direction. These image forming units Pa to Pd are disposed corresponding to different four color (cyan, magenta, yellow and black) images, so as to sequentially form cyan, magenta, yellow and black images, respectively, by steps of charging, exposing, developing and transferring.

These image forming units Pa to Pd are respectively equipped with photosensitive drums (image carriers) 1*a*, 1*b*, 1*c* and 1*d*, which carry visual images (toner images) of individual colors, respectively. Further, an intermediate transfer belt 8 is disposed adjacent to the image forming units Pa to Pd, so as to rotate in a counterclockwise direction in FIG. 1. The toner images formed on the photosensitive drums 1*a* to 1*d* are primarily transferred and overlaid in order onto the intermediate transfer belt 8 that moves while contacting with the photosensitive drums 1*a* to 1*d*. After that, the toner image primarily transferred onto the intermediate transfer belt 8 is secondarily transferred onto a paper sheet S as an example of a recording medium by a secondary transfer roller 9. Further, the paper sheet S with the secondarily transferred toner image is discharged from the main body of the image forming apparatus 100 after the toner image is fixed in a fixing unit 13. The photosensitive drums 1*a* to 1*d* are rotated by a main motor 40 (see FIG. 2) in a clockwise direction in FIG. 1, so that the image forming process is performed on each of the photosensitive drums 1*a* to 1*d*.

The paper sheet S onto which the toner image is to be secondarily transferred is stored in a sheet cassette 16 disposed in a lower part of the main body of the image forming apparatus 100, and is conveyed by a sheet feed roller 12*a* and a registration roller pair 12*b* to a nip between the secondary transfer roller 9 and a drive roller 11 of the intermediate transfer belt 8. A sheet made of dielectric resin is used as the intermediate transfer belt 8, and a belt without a seam (a seamless belt) is mainly used. In addition, on a downstream side of the secondary transfer roller 9, there is disposed a blade-like belt cleaner 19 for removing the toner and the like remaining on a surface of the intermediate transfer belt 8.

Next, the image forming units Pa to Pd are described. The photosensitive drums 1*a* to 1*d* are disposed in a rotatable manner. Around and below the photosensitive drums 1*a* to 1*d*, there are disposed charging devices 2*a*, 2*b*, 2*c* and 2*d*, an exposing device 5, the developing devices 3*a*, 3*b*, 3*c* and 3*d*, and cleaning devices 7*a*, 7*b*, 7*c* and 7*d*. The charging devices 2*a*, 2*b*, 2*c* and 2*d* charge the photosensitive drums 1*a* to 1*d*, respectively. The exposing device 5 exposes the photosensitive drums 1*a* to 1*d* according to image information. The developing devices 3*a*, 3*b*, 3*c* and 3*d* form toner images on the photosensitive drums 1*a* to 1*d*, respectively. The cleaning devices 7*a*, 7*b*, 7*c* and 7*d* remove developer (toner) and the like remaining on the photosensitive drums 1*a* to 1*d*, respectively.

When image data is input from a host device such as a personal computer or the like, the charging devices 2*a* to 2*d* first charge the surfaces of the photosensitive drums 1*a* to 1*d* uniformly. Then, the exposing device 5 emits light beams corresponding to the image data so as to form electrostatic latent images corresponding to the image data on the photosensitive drums 1*a* to 1*d*, respectively. The developing devices 3*a* to 3*d* are filled with predetermined amounts of two-component developers containing cyan, magenta, yellow and black color toners, respectively. Note that, when a ratio of toner in the two-component developer filled in each of the developing devices 3*a* to 3*d* becomes less than a specified value due to toner image formation described later, each of the developing devices 3*a* to 3*d* is replenished with toner from each of toner containers 4*a* to 4*d*. The toner in the developer is supplied to the photosensitive drums 1*a* to 1*d* by the developing devices 3*a* to 3*d*, respectively, so as to attach to the same in an electrostatic manner. When the toner attaches, the toner image is formed corresponding to the electrostatic latent image formed by exposure using the exposing device 5.

Then, a primary transfer roller 6*a* to 6*d* applies an electric field at a predetermined transfer voltage between the primary transfer roller 6*a* to 6*d* and the photosensitive drum 1*a* to 1*d*, so that the cyan, magenta, yellow and black toner images on the photosensitive drums 1*a* to 1*d* are primarily transferred onto the intermediate transfer belt 8. These four color images are formed with predetermined positional relationships for forming a predetermined full color image. After that, as preparation for forming new electrostatic latent images successively, toner and the like remaining on the surfaces of the photosensitive drums 1*a* to 1*d* after the primary transfer are removed by the cleaning devices 7*a* to 7*d*, respectively.

The intermediate transfer belt 8 is stretched around a driven roller 10 on the upstream side and the drive roller 11 on the downstream side. In addition, the secondary transfer roller 9 is disposed adjacent to the drive roller 11. The nip (secondary transfer nip) is formed between the secondary transfer roller 9 and the drive roller 11. When the drive roller 11 is rotated by a belt drive motor (not shown), the intermediate transfer belt 8 starts to rotate. When the intermediate transfer belt 8 rotates in the counterclockwise direction, the paper sheet S is conveyed from the registration roller pair 12*b* to the secondary transfer nip at a predetermined timing. Then, the full color image on the intermediate transfer belt 8 is secondarily transferred onto the paper sheet S. The paper sheet S with the secondarily transferred toner image is conveyed to the fixing unit 13.

The paper sheet S conveyed to the fixing unit 13 is heated and pressed by a fixing roller pair 13*a* so that the toner image is fixed to the surface of the paper sheet S, and a predetermined full color image is formed. The paper sheet S with the full color image formed is conveyed to a branching unit 14 having a plurality of branch directions. The paper sheet S is branched and sent to a double-sided conveying path 18 side or to a discharge roller pair 15 side by the branching unit 14. The paper sheet S is discharged onto a discharge tray 17 by the discharge roller pair 15 after being sent to the double-sided conveying path 18 so that images are formed on both sides, or directly without being sent to the double-sided conveying path 18.

Figure 2:
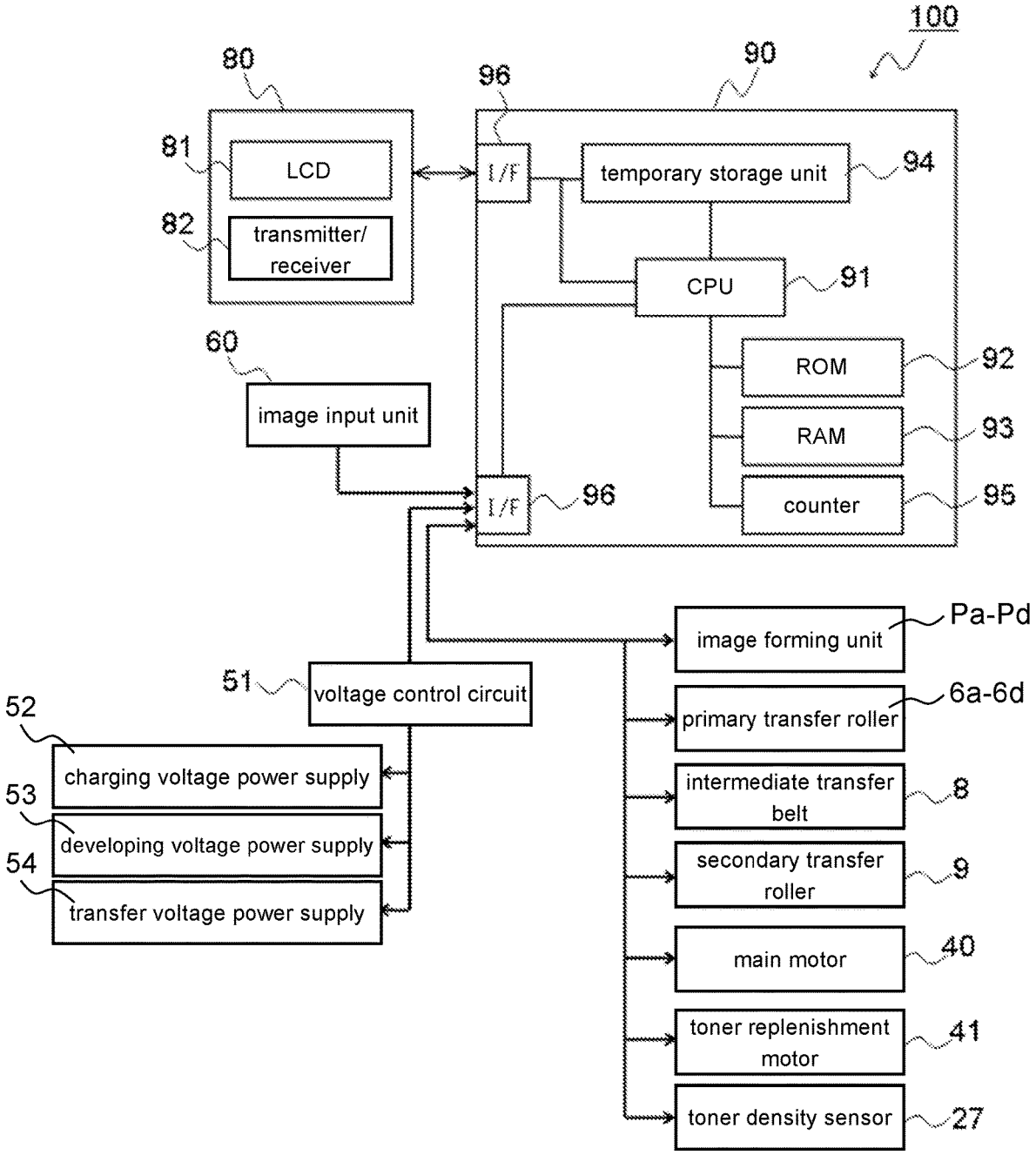
FIG. 2 is a block diagram illustrating an example of a control path used in the image forming apparatus.

Next, a control path of the image forming apparatus 100 is described. FIG. 2 is a block diagram illustrating an example of a control path used in the image forming apparatus 100. Note that various controls of individual portions of the apparatus are performed in use of the image forming apparatus 100, and hence the control path of the entire image forming apparatus 100 is complicated. Therefore, a part of the control path that is necessary for implementing the present disclosure is mainly described below.

A control unit 90 can be disposed at an arbitrary position in the main body of the image forming apparatus 100. The control unit 90 includes at least a central processing unit (CPU) 91, a read only memory (ROM) 92, a random access memory (RAM) 93, a temporary storage unit 94, a counter 95, a plurality of (e.g. two) interfaces (I/Fs) 96. The CPU 91 is a central processing unit. The ROM 92 is a storage unit dedicated to reading. The control unit 90 can be disposed at an arbitrary position in the main body of the image forming apparatus 100. The RAM 93 is a storage unit capable of reading and writing. The temporary storage unit 94 temporarily stores the image data and the like. The I/F 96 transmits control signals to individual devices in the image forming apparatus 100 and receives input signals from an operation unit 80.

The ROM 92 stores a control program of the image forming apparatus 100, and data etc. that are not changed during use of the image forming apparatus 100, such as numerical values necessary for controlling. The RAM 93 stores necessary data generated during control of the image forming apparatus 100, data temporarily necessary for control of the image forming apparatus 100, and the like. The counter 95 accumulates and counts the number of printed sheets.

In addition, the control unit 90 sends control signals from the CPU 91 via the I/F 96 to individual portions and devices in the image forming apparatus 100. In addition, each portion or device in the image forming apparatus 100 sends a signal indicating its status or an input signal via the I/F 96 to the CPU 91. The individual portions and devices controlled by the control unit 90 include, for example, the image forming units Pa to Pd, the exposing device 5, the primary transfer rollers 6*a* to 6*d*, the secondary transfer roller 9, the main motor 40, a toner replenishment motor 41, a voltage control circuit 51, the operation unit 80, and the like.

An image input unit 60 is a receiver that receives the image data sent to the image forming apparatus 100 from the personal computer or the like. The image signal input by the image input unit 60 is converted into a digital signal and is sent to the temporary storage unit 94.

The voltage control circuit 51 is connected to a charging voltage power supply 52, a developing voltage power supply 53, and a transfer voltage power supply 54, and output signals from the control unit 90 operate these power supplies. On the basis of control signals from the voltage control circuit 51, the charging voltage power supply 52 applies a predetermined voltage to the charging devices 2*a* to 2*d*, the developing voltage power supply 53 applies a predetermined voltage to a developing roller 31 in the developing devices 3*a* to 3*d*, and the transfer voltage power supply 54 applies a predetermined voltage to the primary transfer rollers 6*a* to 6*d* and the secondary transfer roller 9.

The operation unit 80 is equipped with a liquid crystal display unit 81, and a transmitter and receiver 82. The liquid crystal display unit 81 displays a status of the image forming apparatus 100, and displays an image forming status and the number of printed sheets. Various settings of the image forming apparatus 100 are performed using a printer driver in the personal computer. The transmitter and receiver 82 performs external communication using a telephone network or the Internet.

Figure 3:
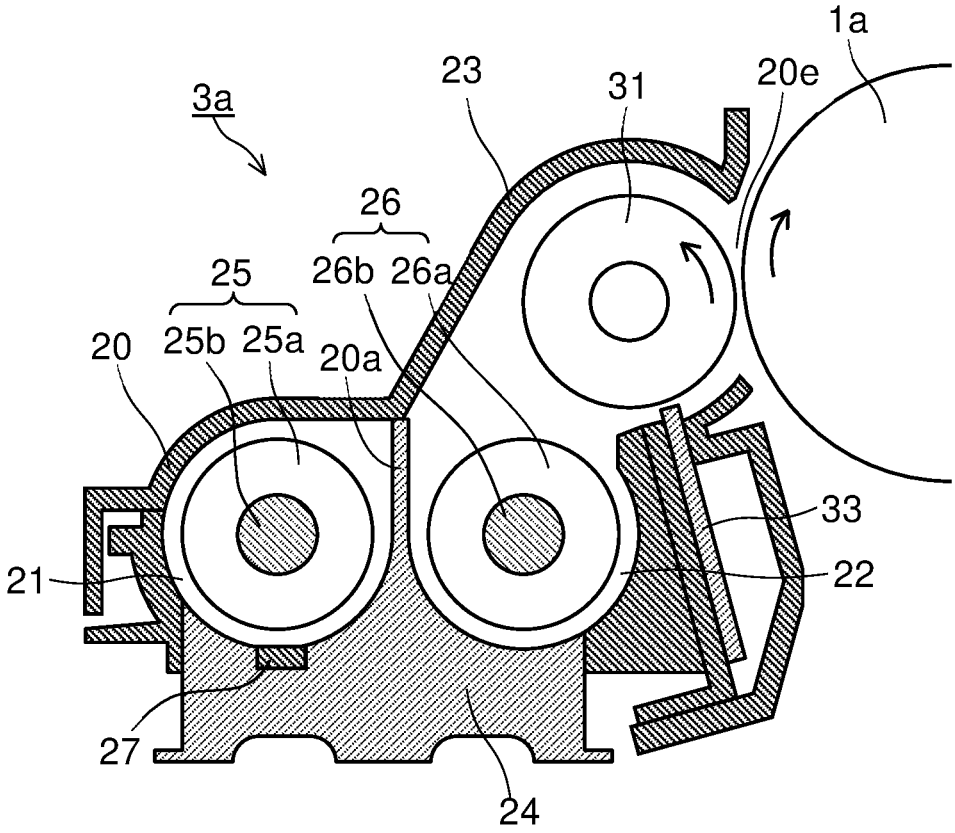
FIG. 3 is a cross-sectional side view of the developing device according to the first embodiment.

FIG. 3 is a cross-sectional side view of the developing device 3*a* according to this embodiment. Note that the following description exemplifies the developing device 3*a* disposed in the image forming unit Pa illustrated in FIG. 1, but the developing devices 3*b* to 3*d* disposed in the other image forming units Pb to Pd have the same basic structure as the developing device 3*a*, and hence overlapping description is omitted.

As illustrated in FIG. 3, the developing device 3*a* includes a developing container 20. The developing container 20 contains two-component developer (hereinafter, also referred to simply as developer) containing magnetic carrier and toner. The developing container 20 has an upper housing 23 and a lower housing 24 facing to each other in a height direction (an up and down direction in the figure). The upper housing 23 and the lower housing 24 are connected to each other. The developing container 20 is divided by a partition wall 20*a* into a stirring transport cell 21 and a supply transport cell 22. Stirring transport members 25 and 26 for charging are disposed in a rotatable manner in the stirring transport cell 21 and the supply transport cell 22, respectively. The stirring transport members 25 and 26 mix the toner supplied from the toner container 4*a* (see FIG. 1) with the magnetic carrier and stir the mixture.

Figure 4:
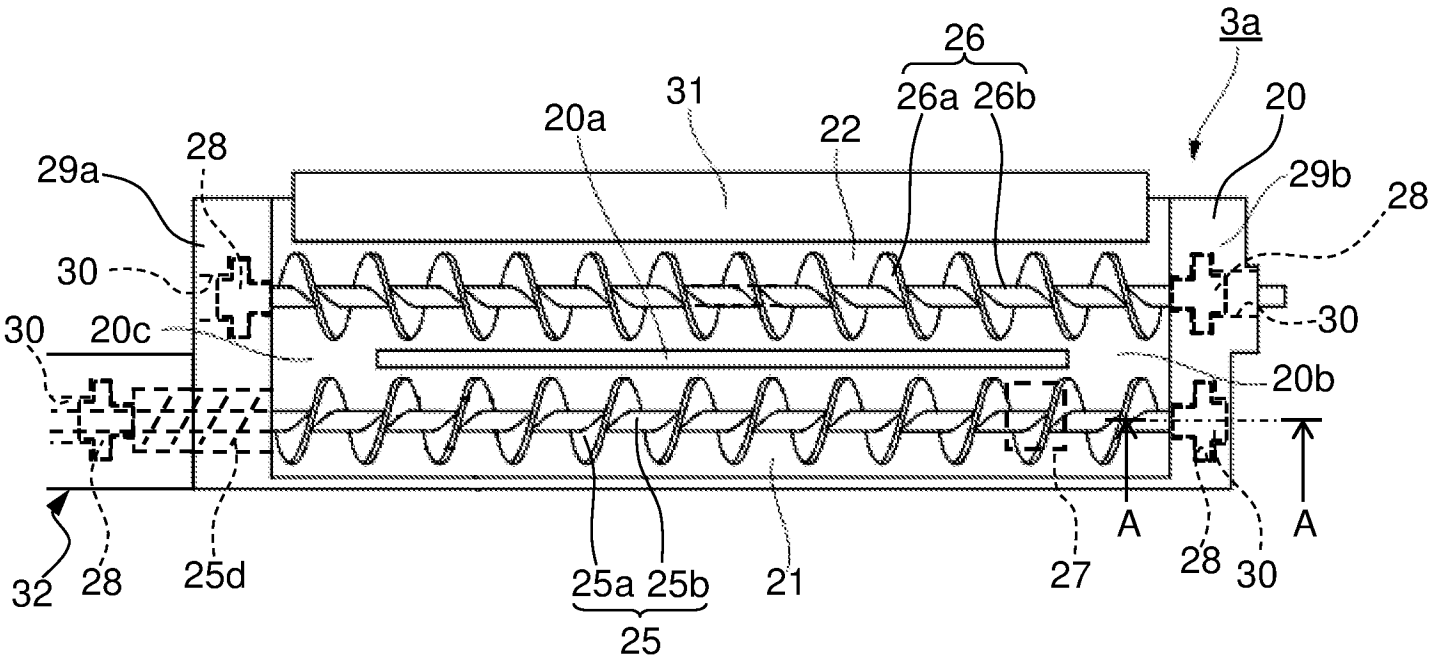
FIG. 4 is a cross-sectional plan view illustrating a stirring portion of the developing device according to the first embodiment.

The developer is stirred by the stirring transport members 25 and 26 and transported in an axial direction (a direction perpendicular to paper of FIG. 3), and it circulates between the stirring transport cell 21 and the supply transport cell 22 through communication portions 20*b* and 20*c* formed at both ends of the partition wall 20*a* (see FIG. 4). In other words, the stirring transport cell 21, the supply transport cell 22, and the communication portions 20*b* and 20*c* constitute a circulation pathway of the developer in the developing container 20.

In the developing container 20, the developing roller (developer carrier) 31 is disposed on an upper right side of the stirring transport member 26 disposed in the supply transport cell 22. Then, a part of the outer periphery surface of the developing roller 31 is exposed through an opening 20*e* of the developing container 20, so as to face the photosensitive drum 1*a*. The developing roller 31 rotates in the counterclockwise direction in FIG. 3. The stirring transport members 25 and 26, and the developing roller 31 are rotated at a predetermined rotation speed by a drive force from the main motor 40 (see FIG. 2).

The developing roller 31 is constituted of a developing sleeve (not shown) and a plurality of magnets (not shown). The developing sleeve has a cylindrical shape and rotates in the counterclockwise direction in FIG. 3. The magnets are fixed in the developing sleeve and have magnetic poles. Note that the developing sleeve having a knurled surface is used in this example, but it may be possible to use one having a surface with many dimples (a dimpled surface), one having a blasted surface, one having a knurled or dimpled plus blasted surface, or one having a plated surface.

In addition, a regulating blade 33 is attached to the developing container 20 along a longitudinal direction of the developing roller 31 (a direction perpendicular to paper of FIG. 3). A small clearance (gap) is formed between a tip of the regulating blade 33 and the surface of the developing roller 31.

The developing device 3*a* is connected to the developing voltage power supply 53 via the voltage control circuit 51 (see FIG. 2). The developing voltage power supply 53 applies the developing roller 31 with a developing voltage in which an AC voltage is superimposed on a DC voltage. The developing voltage and a magnetic force of the magnets in the developing roller 31 allows the developer to be attached to (carried by) the surface of the developing roller 31 so that a magnetic brush is formed.

A toner density sensor 27 is disposed in the stirring transport cell 21 so as to face the stirring transport member 25 in the height direction (the up and down direction in FIG. 3). The toner density sensor 27 detects magnetic permeability of the developer in the developing container 20, so as to detect a toner concentration in the developer (a mixing ratio of the toner to the carrier in the developer, i.e. T/C). The control unit 90 sends a control signal to the toner replenishment motor 41 (see FIG. 2), and the developing container 20 is replenished with the toner from the toner container 4*a* (see FIG. 1) via a toner replenishment portion 32 (see FIG. 4), in accordance with the toner concentration detected by the toner density sensor 27, so that the toner concentration of the developer in the developing container 20 becomes a reference toner concentration.

Next, a structure of a stirring portion of the developing device 3*a* is described in detail. FIG. 4 is a cross-sectional plan view illustrating the stirring portion of the developing device 3*a* according to this embodiment. As described above, in the developing container 20, there are formed the stirring transport cell 21, the supply transport cell 22, the partition wall 20*a*, the upstream side communication portion 20*b*, and the downstream side communication portion 20*c*. In addition to those, the toner replenishment portion 32, and side walls 29*a* and 29*b* are formed. Note that in the stirring transport cell 21, the left side in FIG. 4 is the upstream side, while the right side in FIG. 4 is the downstream side. In addition, in the supply transport cell 22, the right side in FIG. 4 is the upstream side, while the left side in FIG. 4 is the downstream side. Therefore, the upstream side and the downstream side of the communication portions are referred to with respect to the supply transport cell 22.

The partition wall 20*a* extends in the longitudinal direction of the developing container 20 so as to define the stirring transport cell 21 and the supply transport cell 22 in parallel. The right side end part of the partition wall 20*a* in the longitudinal direction forms the upstream side communication portion 20*b* together with the side wall 29*b* of the developing container 20. The left side end part of the partition wall 20*a* in the longitudinal direction forms the downstream side communication portion 20*c* together with the side wall 29*a* of the developing container 20.

The stirring transport member 25 disposed in the stirring transport cell 21 includes the rotation shaft 25*b* and a helical blade (stirring blade) 25*a*. The helical blade 25*a* is formed integrally to the rotation shaft 25*b* in a helical shape at a constant pitch in the axial direction of the rotation shaft 25*b*. The helical blade 25*a* extends to both end sides of the stirring transport cell 21 in the longitudinal direction, so as to face the upstream side communication portion 20*b* and downstream side communication portion 20*c*, too.

The stirring transport member 26 disposed in the supply transport cell 22 includes the rotation shaft 26*b* and a helical blade (stirring blade) 26*a*. The helical blade 26*a* is formed integrally to the rotation shaft 26*b* in a helical shape at the same pitch as the helical blade 25*a* in the axial direction of the rotation shaft 26*b*, and in the direction opposite to the helical blade 25*a* (in the opposite phase). The helical blade 26*a* has a length longer than the developing roller 31 in the axial direction, so as to face the upstream side communication portion 20*b* and the downstream side communication portion 20*c*, too.

The toner replenishment portion 32 is disposed on the upstream side of the stirring transport cell 21 (the left side in FIG. 4). The toner replenishment portion 32 is connected to the toner container 4*a* (see FIG. 1) via a toner replenishment pathway (not shown). The toner replenishment portion 32 replenishes the developing container 20 with new toner stored in the toner container 4*a*. The rotation shaft 25*b* of the stirring transport member 25 extends to the inside of the toner replenishment portion 32. At a part of the rotation shaft 25*b* disposed in the toner replenishment portion 32, a replenishment blade 25*d* is formed integrally to the rotation shaft 25*b*. The replenishment blade 25*d* is formed in a helical shape at a constant pitch in the axial direction of the rotation shaft 25*b*.

In this way, the developer is stirred and circulated from the stirring transport cell 21 to the upstream side communication portion 20*b*, to the supply transport cell 22, and to the downstream side communication portion 20*c*, so that the stirred developer is supplied to the developing roller 31. As the toner is consumed by developing, the toner replenishment motor 41 (see FIG. 2) operates so that the stirring transport cell 21 is replenished with toner from the toner container 4*a* through the toner replenishment portion 32.

The rotation shafts 25*b* and 26*b* are disposed in parallel to each other. Bearings 28 are disposed on both ends of the rotation shafts 25*b* and 26*b* in the longitudinal direction. The bearings 28 support the rotation shafts 25*b* and 26*b* in a rotatable manner.

The rotation shaft 26*b* disposed in the supply transport cell 22 is supported by the bearing 28 attached to the side wall 29*b* at the upstream side communication portion 20*b* and the bearing 28 attached to the side wall 29*a* of the downstream side communication portion 20*c*. These bearings 28 are fixed by fitting in through holes 30 formed in the side walls 29*a* and 29*b*, respectively.

The rotation shaft 25*b* disposed in the stirring transport cell 21 is supported by the bearing 28 attached to the side wall 29*b* at the upstream side communication portion 20*b* and the bearing 28 attached to the toner replenishment portion 32. These bearings 28 are fixed by fitting in the through hole 30 formed in the side wall 29*b* and the through hole 30 provided to the replenishment portion 32.

Next, engagement between the bearing 28 for supporting the rotation shaft 25*b*, 26*b* and the through hole 30 in which the bearing 28 fits is described in detail with reference to FIG. 5. The through holes 30 are disposed at the side wall 29*b* of the upstream side communication portion 20*b*, at the side wall 29*a* of the downstream side communication portion 20*c*, and at the toner replenishment portion 32. Each of the bearings 28 fits in each of the through holes 30. The engagements between the through holes 30 and the bearings 28 have the same structure. Therefore, only the engagement between the through hole 30 disposed at the side wall 29*b* of the upstream side communication portion 20*b* and the bearing 28 fitting in that through hole 30 is described, and descriptions of the engagements between the through holes 30 and the bearings 28 at other positions are omitted.

Figure 5:
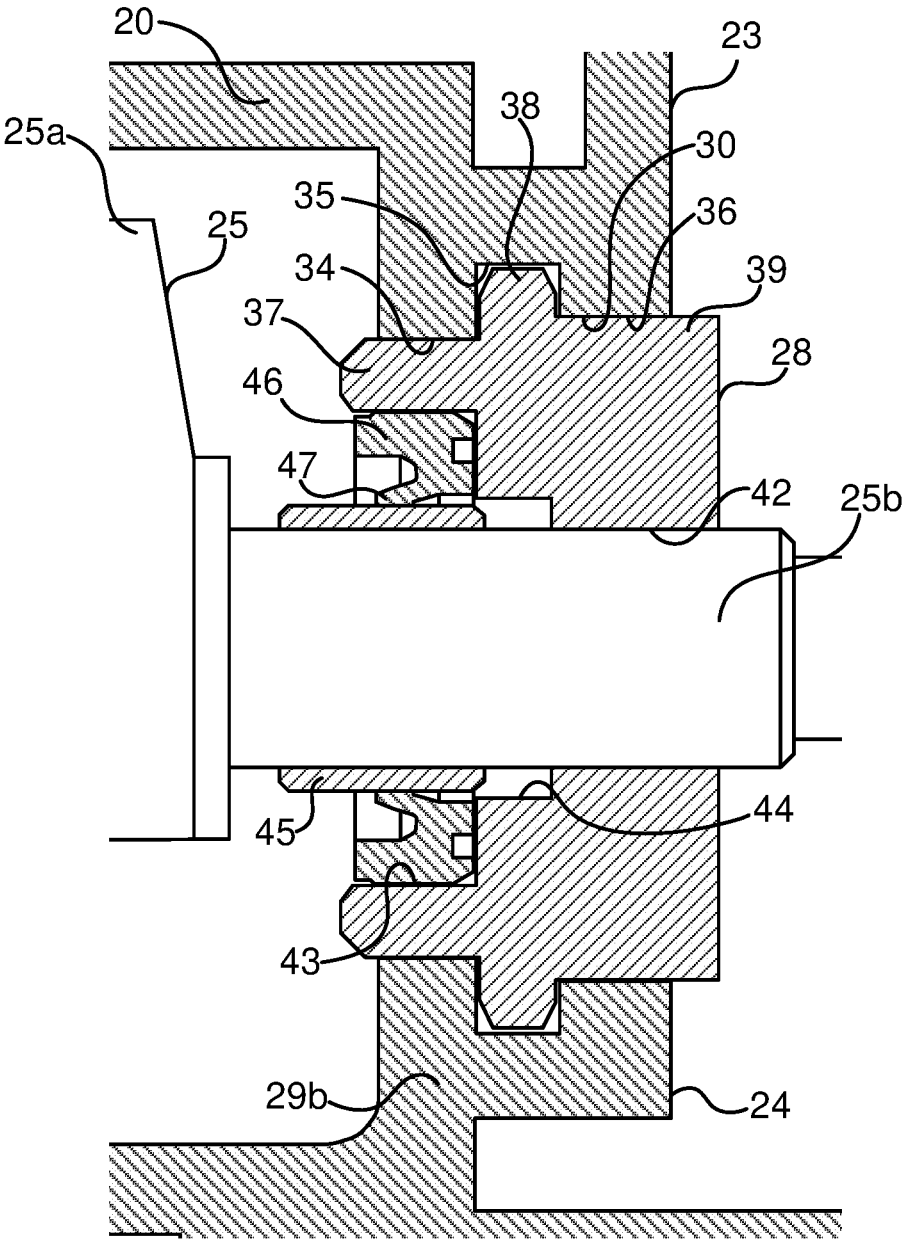
FIG. 5 is a cross-sectional view illustrating a cross section of a developing container taken along an A-A cross sectional line illustrated in FIG. 4.

FIG. 5 is a cross-sectional view illustrating a cross section of the developing container 20 taken along an A-A cross sectional line illustrated in FIG. 4. The through hole 30 is divided into an upper housing 23 side and a lower housing 24 side of the developing container 20. When the upper housing 23 and the lower housing 24 are connected to each other, the part of the through hole 30 formed in the upper housing 23 and the part of the through hole 30 formed in the lower housing 24 are combined to form the single through hole 30.

The inner periphery surface of the through hole 30 is formed to have a first inner periphery part 34, a container side engaging part 35, and a second inner periphery part 36. The container side engaging part 35 is positioned outside the first inner periphery part 34 in the axial direction. In addition, the container side engaging part 35 is positioned inside the second inner periphery part 36 in the axial direction. The first inner periphery part 34 extends from the inside surface in the axial direction of the side wall 29*b* outward in the axial direction to the position of the container side engaging part 35. The second inner periphery part 36 extends from the outside surface in the axial direction of the side wall 29*b* inward in the axial direction to the position of the container side engaging part 35.

The container side engaging part 35 is depressed to a position outside the first inner periphery part 34 and the second inner periphery part 36 in the radial direction. In other words, the inner diameter of the container side engaging part 35 is larger than that of other part in the axial direction of the through hole 30 (than the inner diameters of the first inner periphery part 34 and the second inner periphery part 36). The inner diameter of the second inner periphery part 36 is larger than that of the first inner periphery part 34.

The outer periphery surface of the bearing 28 is formed to have a first outer periphery part 37, a bearing side engaging part 38, and a second outer periphery part 39. The bearing side engaging part 38 is positioned outside the first outer periphery part 37 in the axial direction. In addition, the bearing side engaging part 38 is positioned inside the second outer periphery part 39 in the axial direction. The first outer periphery part 37 extends from the inside end in the axial direction of the bearing 28 outward in the axial direction to the position of the bearing side engaging part 38. The second outer periphery part 39 extends from the outside end in the axial direction of the bearing 28 inward in the axial direction to the position of the bearing side engaging part 38.

The bearing side engaging part 38 protrudes to a position outside the first outer periphery part 37 and the second outer periphery part 39 in the radial direction. In other words, the outer diameter of the bearing side engaging part 38 is larger than that of other part in the axial direction of the bearing 28 (than the outer diameters of the first outer periphery part 37 and the second outer periphery part 39). The outer diameter of the second outer periphery part 39 is larger than that of the first outer periphery part 37.

The position in the axial direction of the first outer periphery part 37 of the bearing 28 is the same as that of the first inner periphery part 34 of the through hole 30. The outer periphery surface of the first outer periphery part 37 contacts with the inner periphery surface of the first inner periphery part 34. The position in the axial direction of the second outer periphery part 39 is the same as that of the second inner periphery part 36. The outer periphery surface of the second outer periphery part 39 contacts with the inner periphery surface of the second inner periphery part 36.

The position in the axial direction of the bearing side engaging part 38 is the same as that of the container side engaging part 35. The outer diameter of the bearing side engaging part 38 is smaller than the inner diameter of the container side engaging part 35. The thickness in the axial direction of the bearing side engaging part 38 is smaller than the width in the axial direction of the container side engaging part 35.

The bearing side engaging part 38 is inserted in the container side engaging part 35, so that the bearing side engaging part 38 and the container side engaging part 35 are engaged with each other. This engagement forms a gap between the bearing 28 and the developing container 20, which is dented and projected in the radial direction. More specifically, the gap between the first outer periphery part 37 and the first inner periphery part 34, as well as the gap between the second outer periphery part 39 and the second inner periphery part 36 extends in the axial direction. Further, the gap between the axial direction inside surface of the bearing side engaging part 38 and the axial direction outside surface of the container side engaging part 35 extends in the radial direction. The gap between the distal end of the bearing side engaging part 38 and the bottom in the radial direction of the container side engaging part 35 extends in the axial direction. The gap between the axial direction outside surface of the bearing side engaging part 38 and the axial direction inside surface of the container side engaging part 35 extends in the radial direction.

Note that the first outer periphery part 37 and the first inner periphery part 34 contact with each other by surface contact, and the gap between the first outer periphery part 37 and the first inner periphery part 34 is so small that the developer can barely enter in the gap. Similarly, the second outer periphery part 39 and the second inner periphery part 36 contact with each other by surface contact, and the gap between the second outer periphery part 39 and the second inner periphery part 36 is so small that the developer can barely enter in the gap.

At the center of the bearing 28 in the radial direction, a first positioning hole 43, a second positioning hole 44, and a shaft insertion hole 42 are formed to penetrate the bearing 28 in the axial direction. The first positioning hole 43 opens in the inside end surface in the axial direction of the bearing 28, and extends from its opening edge outward in the axial direction. The second positioning hole 44 is next to the first positioning hole 43 in the axial direction. The inner diameter of the second positioning hole 44 is smaller than that of the first positioning hole 43. The second positioning hole 44 opens in the bottom of the first positioning hole 43 in the axial direction, and extends from its opening edge outward in the axial direction.

The shaft insertion hole 42 is next to the second positioning hole 44 in the axial direction. The inner diameter of the shaft insertion hole 42 is smaller than that of the second positioning hole 44. The shaft insertion hole 42 opens in the bottom of the second positioning hole 44 in the axial direction, and extends from its opening edge in the axial direction. The shaft insertion hole 42 opens in the outside end surface in the axial direction of the bearing 28.

The rotation shaft 25*b* is inserted in the first positioning hole 43, the second positioning hole 44, and the shaft insertion hole 42. The outer periphery surface of the rotation shaft 25*b* contacts with the inner periphery surface of the shaft insertion hole 42.

A ring member 45 is fit on the rotation shaft 25*b*. The ring member 45 penetrates the first positioning hole 43 in the axial direction from the opening of the first positioning hole 43 and is inserted in the second positioning hole 44. The inner periphery surface of the ring member 45 contacts with the outer periphery surface of the rotation shaft 25*b*. A friction coefficient of the inner periphery surface of the ring member 45 is smaller than that of a lip part 47 disposed at the inner periphery surface of a seal member 46 (details will be described later). When the rotation shaft 25*b* rotates, the outer periphery surface of the rotation shaft 25*b* slides on the inner periphery surface of the ring member 45 and on the inner periphery surface of the shaft insertion hole 42.

The seal member 46 is disposed between the ring member 45 and the bearing 28. The seal member 46 is inserted in the first positioning hole 43. The outer diameter of the seal member 46 is slightly larger than the inner diameter of the first positioning hole 43. Thus, the seal member 46 is fixed by being pressed in the first positioning hole 43.

The seal member 46 has the lip part 47 extending inward in the radial direction from the inner periphery surface of the seal member 46. The lip part 47 is elastically deformed by contacting with the outer periphery surface of the ring member 45, and its restoring force presses the ring member 45 inward in the radial direction. In this way, the gap between the ring member 45 and the seal member 46 is sealed.

As described above, the gap between the bearing 28 and the developing container 20 has a complicated shape, which is dented and projected in the radial direction. Therefore, developer entering the gap between the bearing 28 and the developing container 20 can hardly flow, and it can be prevented that the developer flows through the gap to the outside of the developing container 20.

More specifically, if the developer entering the gap between the bearing 28 and the through hole 30 moves in the axial direction, the developer should move in the axial direction in the gap between the first outer periphery part 37 and the first inner periphery part 34. Further, the developer should move in the radial direction in the gap between the axial direction inside surface of the bearing side engaging part 38 and the axial direction outside surface of the container side engaging part 35. Further, the developer should move in the axial direction in the gap between the distal end of the bearing side engaging part 38 and the bottom in the radial direction of the container side engaging part 35. Further, the developer should move in the radial direction in the gap between the axial direction outside surface of the bearing side engaging part 38 and the axial direction inside surface of the container side engaging part 35. Further, the developer should move in the axial direction in the gap between the second outer periphery part 39 and the second inner periphery part 36.

In this way, the movement direction of the developer entering the gap between the bearing 28 and the through hole 30 changes sequentially between the axial direction and the radial direction. In this way, the gap between the bearing 28 and the through hole 30 has a shape that prevents the developer from moving, even if the developer enters the gap. Therefore, it is possible to prevent the developer from moving through the gap between the bearing 28 and the through hole 30 to the outside of the developing container 20.

In addition, because the engagement between the container side engaging part 35 and the bearing side engaging part 38 can prevent the developer from flowing out as described above, it is not necessary to add another seal member or the like between the bearing 28 and the through hole 30 to prevent leakage of developer. Therefore, the number of components can be decreased, an increase in manufacturing cost can be suppressed, and deterioration in assembling performance can be suppressed.

Further, when assembling the developing container 20, the upper housing 23 and the lower housing 24 can be connected in a state where the bearing 28 is fit in a part of the through hole 30 formed in the upper housing 23 or the lower housing 24. Therefore, when connecting the upper housing 23 and the lower housing 24, it is not necessary to position the bearing 28 by additional means. In addition, when the upper housing 23 and the lower housing 24 are connected, the bearing side engaging part 38 of the bearing 28 and the container side engaging part 35 are engaged with each other. Therefore, without using an additional retaining member such as a retaining ring or a bonding agent, it is possible to retain the bearing 28 in the through hole 30. In this way, the number of components can be decreased, an increase in manufacturing cost can be suppressed, and deterioration in assembling performance can be suppressed.

In addition, as described above, the outer diameter of the second outer periphery part 39 is larger than that of the first outer periphery part 37, and the inner diameter of the second inner periphery part 36 is larger than that of the first inner periphery part 34. In other words, the bearing 28 and the through hole 30 each has an asymmetric shape with respect to the center in the axial direction. Therefore, when attaching the bearing 28 to the through hole 30, the orientation of the bearing 28 is limited to one orientation. Therefore, it can be avoided that the bearing 28 is placed in the through hole 30 in the wrong (opposite) orientation. In this way, deterioration in assembling performance of the developing devices 3*a* to 3*d* can be further suppressed.

In addition, as described above, the seal member 46 seals the gap between the ring member 45 and the seal member 46. Therefore, it is possible to prevent the developer from entering the gap between the ring member 45 and the bearing 28, and from flowing through the gap between the bearing 28 and the rotation shaft 25*b*, 26*b* to the outside of the developing container 20.

In addition, as described above, the ring member 45 contacts with the rotation shaft 25*b*, 26*b* by its inner periphery surface having a friction coefficient smaller than that of the lip part 47 of the seal member 46. Therefore, the seal member 46 seals the gap between the bearing 28 and the rotation shafts 25*b* and 26*b*, while the seal member 46 does not disturb the rotation of the rotation shaft 25*b*, 26*b*. In this way, the developer in the developing container 20 can be efficiently stirred and supplied.

In addition, the seal member 46 is inserted in the first positioning hole 43. Therefore, positioning of the seal member 46 in the axial direction with respect to the rotation shaft 25*b*, 26*b* can be easily performed. Further, the ring member 45 is inserted in the first positioning hole 43 and the second positioning hole 44. Therefore, positioning of the ring member 45 and the bearing 28 in the axial direction can be easily performed. In this way, deterioration in assembling performance of the developing devices 3*a* to 3*d* can be suppressed.

As described above, it is possible to provide the developing device that can suppress an increase in manufacturing cost or deterioration in assembling performance, and can prevent the developer from flowing out of the developing container.

Figure 6:
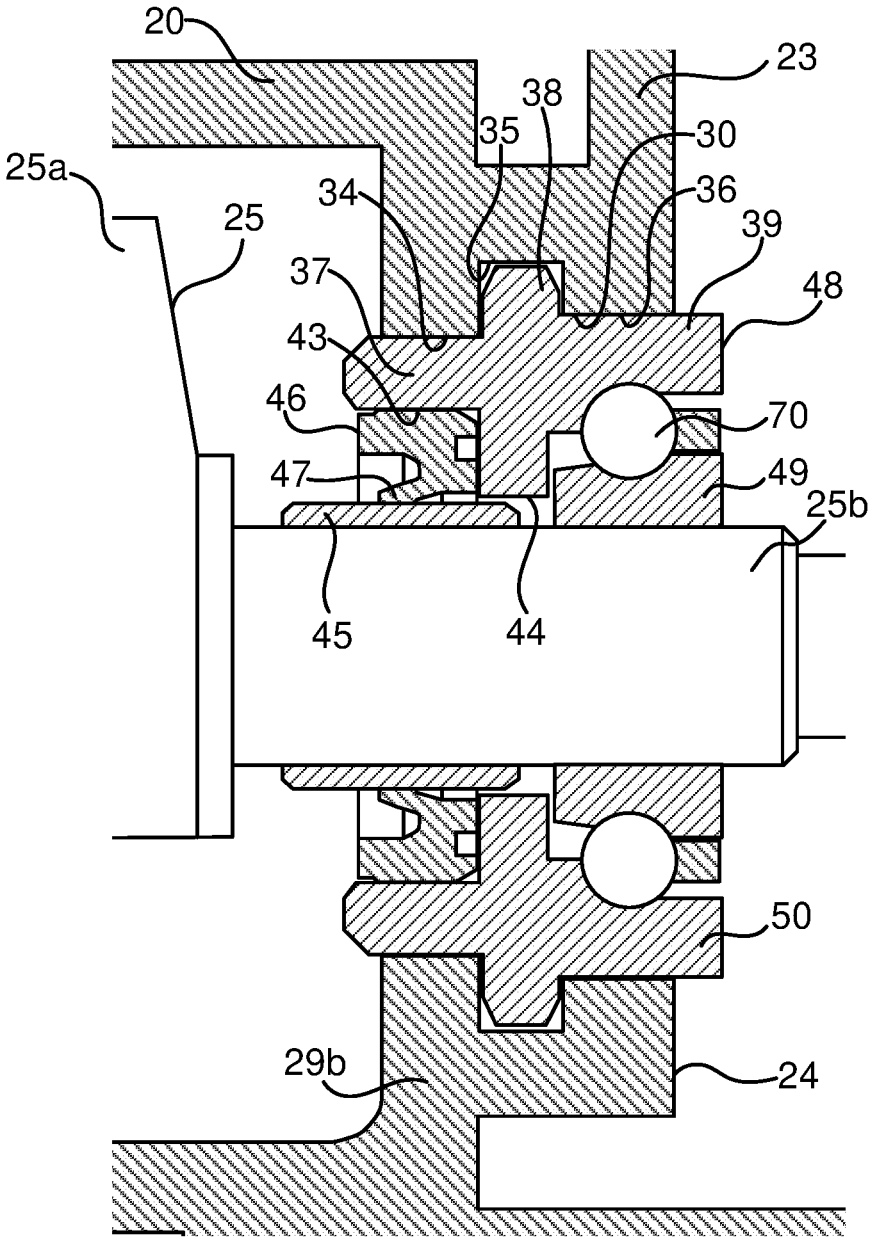
FIG. 6 is a partial enlarged cross-sectional view illustrating a bearing and its vicinity of the developing container according to a second embodiment.

Next, the developing devices 3*a* to 3*d* according to a second embodiment of the present disclosure are described in detail with reference to FIG. 6.

A bearing 48 is disposed at each end in the longitudinal direction of the rotation shaft 25*b*, 26*b* of this embodiment. The bearing 48 is a ball bearing including an inner ring 49, an outer ring 50, and a plurality of rotary members 70. The inner ring 49 is fixed to the rotation shaft 25*b*, 26*b* at a position outside the seal member 46 in the axial direction. The outer ring 50 is disposed to face the inner ring 49 in the radial direction. The outer ring 50 is fixed by fitting in the through hole 30. The plurality of rotary members 70 are spherical rolling bodies disposed between the inner ring 49 and the outer ring 50 at predetermined spaces in the circumferential direction. It may be possible to adopt a structure including a retainer between the inner ring 49 and the outer ring 50 for spacing the rotary members 70 at predetermined spaces in the circumferential direction.

The first outer periphery part 37, the bearing side engaging part 38, and the second outer periphery part 39 are formed on the outer periphery surface of the outer ring 50. The outer ring 50 has the first positioning hole 43 dented outward in the axial direction from the inside end surface in the axial direction of the bearing 48, and the second positioning hole 44 extending outward in the axial direction from the bottom in the axial direction of the first positioning hole 43. The ring member 45 penetrates the first positioning hole 43 in the axial direction and is inserted in the second positioning hole 44. The axial direction outside end surface of the ring member 45 faces the axial direction inside end surface of the inner ring 49 in the axial direction.

Because the bearing 48 is the ball bearing including the inner ring 49, the outer ring 50, and the rotary members 70, it is possible to reduce frictional resistance when the rotation shaft 25*b*, 26*b* rotates, and to efficiently stir and supply the developer in the developing container 20.

Other than that, the present disclosure is not limited to the embodiments described above but can be variously modified within the scope of the present disclosure without deviating from the spirit thereof. For instance, the present disclosure can be applied not only to the tandem type color printer illustrated in FIG. 1 but also to a digital or analog monochrome copier, a monochrome printer, a color copier, a facsimile machine, or other various image forming apparatus using a two-component developing method.

In addition, the outer diameter of the bearing side engaging part 38 is larger than that of other part in the axial direction of the bearing 28 in the embodiments described above, but it may be possible to adopt a structure in which it is smaller than the outer diameter of other part in the axial direction of the bearing 28. In other words, it may be possible to adopt a structure in which the bearing side engaging part 38 is dented to a position inner in the radial direction than the first outer periphery part 37 and the second outer periphery part 39. In this case, the container side engaging part 35 protrudes to a position inner in the radial direction than the first inner periphery part 34 and the second inner periphery part 36 so as to be inserted in the bearing side engaging part 38. In other words, the inner diameter of the container side engaging part 35 is smaller than that of other part in the axial direction of the through hole 30 (than the inner diameters of the first inner periphery part 34 and the second inner periphery part 36). In addition, it is possible to dispose two or more pairs of the container side engaging part 35 and the bearing side engaging part 38.

In addition, the bearing 48 of the second embodiment is the ball bearing having the rotary members 70 that are the spherical rolling bodies, but the bearing 48 may be a roller bearing having the rolling bodies having a cone shape, a cylindrical shape, or the like.

The present disclosure can be applied to developing devices including a stirring transport member that stirs and transports developer. It is possible to provide a developing device capable of preventing developer from flowing out of a developing container while suppressing an increase in manufacturing cost and deterioration in assembling performance.

What is claimed is:

1. A developing device comprising:

a developing container for storing developer containing toner;

a developer carrier for carrying the toner in the developing container;

a bearing fixed by being inserted in a through hole provided to the developing container;

a stirring transport member including a rotation shaft supported by the bearing in a rotatable manner, and a stirring blade formed on an outer periphery surface of the rotation shaft, so as to stir and transport the developer in the developing container; and a seal member disposed between the bearing and the rotation shaft, wherein the developing container has an upper housing and a lower housing connected to the upper housing, the through hole is divided into an upper housing side and a lower housing side, the bearing has a bearing side engaging part formed on an outer periphery surface of the bearing, the bearing side engaging part having an outer diameter different from that of other part in the axial direction of the bearing, a first outer periphery part positioned inside the bearing side engaging part in the axial direction, and a second outer periphery part positioned outside the same in the axial direction, and the through hole has an inner periphery surface on which a container side engaging part engaging with the bearing side engaging part is formed at the same position in the axial direction as the bearing side engaging part, the container side engaging part having an inner diameter different from that of other part in the axial direction of the through hole.

2. The developing device according to claim 1, wherein the first outer periphery part has an outer diameter different from that of the second outer periphery part.

3. The developing device according to claim 1, wherein the bearing side engaging part protrudes from the outer periphery surface of the bearing outward in a radial direction of the rotation shaft, and the container side engaging part is dented from the inner periphery surface of the through hole outward in the radial direction.

4. The developing device according to claim 1, further comprising a ring member disposed between the rotation shaft and the seal member, the ring member contacting with the rotation shaft by its inner periphery surface having a friction coefficient to the rotation shaft smaller than that of the seal member, wherein the bearing has a first positioning hole in which the seal member and the ring member are inserted, the first positioning hole opening in an end surface in the axial direction of the first outer periphery part so as to extend outward from a center in a radial direction of the rotation shaft, and a second positioning hole in which the ring member is inserted, the second positioning hole being dented from the bottom in the axial direction of the first positioning hole toward the axial direction.

5. The developing device according to claim 1, wherein a plurality of pairs of the bearing side engaging part and the container side engaging part are disposed side by side in the axial direction.

6. The developing device according to claim 1, wherein the bearing includes an inner ring fixed to the outer periphery surface of the rotation shaft at a position outside the seal member in the axial direction, an outer ring fixed to the through hole so as to face the inner ring in a radial direction of the rotation shaft, and a plurality of rotary members disposed between the inner ring and the outer ring so as to be capable of rotating in a circumferential direction of the rotation shaft.

7. An image forming apparatus comprising the developing device according to claim 1.

* * * * *